US008973924B2

(12) United States Patent
Rullier et al.

(10) Patent No.: US 8,973,924 B2
(45) Date of Patent: Mar. 10, 2015

(54) DEVICE FOR ADJUSTING THE POSITION OF THE BOOT SUPPORT HOLDER IN A SKI FASTENING SYSTEM

(71) Applicant: Skis Rossignol, Saint-Jean-de-Moirans (FR)

(72) Inventors: Pierre Rullier, Annecy le Vieux (FR); Gerard Thomas, Urzy (FR); Marion Meyronneinc, Fontaine (FR)

(73) Assignee: Skis Rossignol, Saint-Jean de Moirans (FR)

( * ) Notice: Subject to any disclaimer, the term of this patent is extended or adjusted under 35 U.S.C. 154(b) by 0 days.

(21) Appl. No.: 14/244,520

(22) Filed: Apr. 3, 2014

(65) Prior Publication Data

US 2014/0300068 A1 Oct. 9, 2014

(30) Foreign Application Priority Data

Apr. 3, 2013 (FR) ..... 13 52994

(51) Int. Cl.

| | |
|---|---|
| ***A63C 1/04*** | (2006.01) |
| ***A63C 9/22*** | (2012.01) |
| ***A63C 9/00*** | (2012.01) |
| ***A63C 9/08*** | (2012.01) |
| ***A63C 9/081*** | (2012.01) |
| ***A63C 9/085*** | (2012.01) |

(52) U.S. Cl.

CPC . *A63C 9/22* (2013.01); *A63C 9/001* (2013.01); *A63C 9/005* (2013.01); *A63C 9/0807* (2013.01); *A63C 9/081* (2013.01); *A63C 9/0855* (2013.01); *A63C 9/08564* (2013.01)

USPC ..... 280/11.33

(58) Field of Classification Search

USPC ..... 280/11.23, 611–618

See application file for complete search history.

(56) References Cited

U.S. PATENT DOCUMENTS

| | | | | |
|---|---|---|---|---|
| 1,550,381 | A | 8/1925 | Massolle et al. | |
| 3,810,645 | A * | 5/1974 | Vouthier | 280/633 |
| 4,586,727 | A * | 5/1986 | Andrieu et al. | 280/607 |

(Continued)

FOREIGN PATENT DOCUMENTS

| | | | |
|---|---|---|---|
| DE | 368900 | C | 4/1924 |
| EP | 0 345 371 | A | 12/1989 |

(Continued)

OTHER PUBLICATIONS

Search Report issued by French Patent Office for priority French application 1352994 dated Dec. 13, 2013.

*Primary Examiner* — John Walters
*Assistant Examiner* — James Triggs
(74) *Attorney, Agent, or Firm* — Frommer Lawrence & Haug LLP; Ronald R. Santucci

(57) ABSTRACT

The present invention relates to a device for adjusting the vertical position of the boot support holder (P) for a ski fastening system comprising a base (E) and a plate (Cr) forming a cover, said support holder comprising a vertically movable support element (1) and at least one ramp (11) cooperating by contact with a wedge (2) that can move in longitudinal translation under the action of a maneuvering member (3), characterized in that said maneuvering member (3) can rotate relative to the base while being connected to said wedge (2), which bears a push-piece (21) forming a lever designed to come into bearing contact against said ramp to modify the vertical position of the support element (3) by pivoting.

18 Claims, 10 Drawing Sheets

(56) References Cited

U.S. PATENT DOCUMENTS

| | | | | |
|---|---|---|---|---|
| 5,326,127 | A * | 7/1994 | Mercat et al. | 280/632 |
| 5,855,390 | A * | 1/1999 | Hassell | 280/607 |
| 8,181,985 | B2 * | 5/2012 | Mangold et al. | 280/614 |
| 2012/0104707 | A1 * | 5/2012 | Merino et al. | 280/11.33 |

FOREIGN PATENT DOCUMENTS

| | | | |
|---|---|---|---|
| EP | 0 595 170 | A | 5/1994 |
| FR | 1 557 276 | | 2/1969 |
| FR | 2 555 457 | A | 11/1983 |
| WO | WO 2007/060219 | A | 5/2007 |

* cited by examiner

DEVICE FOR ADJUSTING THE POSITION OF THE BOOT SUPPORT HOLDER IN A SKI FASTENING SYSTEM

The present invention relates to a device for adjusting the vertical position of a support holder for a boot on a ski.

The invention more particularly relates to a device making it possible to adapt the height of the support holder, equipping the front stop of the fastening system, for different types of boot soles.

The front stop of the known fastening systems comprises, in particular and essentially, a base for mounting on the upper surface of the ski and a body provided with a movable jaw designed to engage with the front part of a boot, if applicable, the body is provided with a plate that extends toward the rear above the base while forming a cover.

The body or the base of the stop is generally provided with a holder situated behind the jaw on which the sole of the boot bears.

This holder is designed to facilitate the transverse offset of the boot and the automatic opening of the jaw in the event a predetermined stress level is exceeded by decreasing the friction forces between the sole of the boot and the holder.

In general, ski boots include a fixed sole, the front part of which has a protruding rim called a "curb" that engages and becomes wedged in the jaw.

For boots intended for Alpine skiing, this curb generally has a standard height of approximately 20 mm (Alpine standard ISO 5355).

Today, the front stops of the fastening systems for Alpine skiing are all designed in order to adapt to this dimension, which has become practically standardized.

However, boots also exist that are designed for other types of skiing, and for example, for cross-country skiing (or touring) specifically, and whereof the dimensions of the curb are significantly larger (approximately 30 mm, Cross-Country standard ISO 9523, or between 20 and 30 mm for other types of boots favoring walking).

The structure and safety allowances of the fastening systems dedicated to these other ski methods are generally adapted to these boot shapes by design.

Consequently, to offset the dimensional deviations between the different types of ski boots, the bearing holders associated with the front stops of the fastening systems (which, for obvious safety and reliability reasons, only offer very limited adjustment freedom for the vertical travel of the jaw) have sometimes been equipped with means for adjusting the height.

Such adjustable holders are in particular described in FR 2,555,457 and DE 368,900.

These holders are made up of two parts, namely a lower part forming a wedge and an upper part supporting the holder, respectively. These parts include opposite inclined faces on which notches are formed that are designed to keep them engaged with each other.

The relative positioning of the two parts (which is done in the free state, before fastening the boot) makes it possible to adjust the height of the holder.

However, these holders do not have sufficient bearing surfaces for the boot irrespective of their position because the upper part is always downwardly or upwardly offset relative to the lower part.

Furthermore, the locking of the two parts is not reliable, which poses a safety problem, since it is not possible to guarantee the complete absence of sliding of the upper part, in particular, in case of wear of the retaining notches.

Lastly, adjusting the position of the holder is difficult because the parts are difficult to handle due to their small dimensions and there is no identifying reference for the final height.

EP 0,595,170 describes a device for adjusting the position of the support holder comprising a support element that is vertically movable and at least one ramp cooperating by contact with a wedge that is capable of moving in longitudinal translation under the action of a maneuvering member.

However, the manual movement of the wedge does not in itself lead to the lifting or lowering of the support element of the holder.

In fact, it is not the holder that moves the support element between the upper and lower positions, but only the subsequent bearing of the boot.

The aim of the invention is therefore to resolve these technical problems by proposing an ergonomic, simple and effective adjusting device, capable of offering skiers better adaptability and increased safety.

This aim is achieved using a device for adjusting the support holder that is characterized in that said maneuvering member can rotate relative to the base while being connected to said wedge, which bears a push-piece forming a lever designed to come into bearing contact against said ramp to modify the vertical position of the support element by pivoting.

According to one advantageous feature, said maneuvering member comprises a cylindrical stud rotatably housed in an asymmetrical bore of the plate forming a cover.

According to another advantageous feature, said maneuvering member is connected to said wedge via a cam.

According to one specific alternative, said cam is made up of an eccentric bearing a slug protruding downward through an oblong aperture formed in said wedge.

Preferably, said asymmetrical bore is delimited on the one hand by a semi-cylindrical edge coming into contact with the eccentric during the rotation of the member, and on the other hand by a substantially triangular edge whereof the distance to the center of the bore is smaller than the radius of the edge and whereof the ends form end-of-travel stops for the rotating stud.

Advantageously, the head of said stud is provided with a hollow for the insertion of an adjusting tool.

According to one feature, said oblong aperture is formed in a tab of the wedge extending on the side opposite the push-piece.

The support element pivots around a transverse axis.

The pivot axis is preferably embodied by two pivots positioned on either side of the support element and that are engaged in bearings formed side niches of the base.

In front of the ramp, the support element comprises a first bearing shoulder on the wedge corresponding to a low position of the holder, and behind the ramp, it comprises a second bearing shoulder on the wedge delimiting an upper position of the holder at the end of travel of the push-piece.

Following the pivoting of the support element, said first or second bearing shoulder extends in a horizontal plane corresponding to the lower position or the upper position of the holder, respectively.

Said push-piece of the wedge includes an upper wall on which said bearing shoulders of the support element of the holder rest.

In parallel, it is provided that said wedge includes two lateral lugs sliding in guide and retaining cells formed on each of the flanks of the support element of the holder.

Preferably, these cells have an upper portion that is open for the insertion of the lugs that extends downward, via a bent portion, by a closed lower portion in which said lugs abut.

According to still another alternative, said wedge is housed in a recess of the bottom of the base.

Furthermore, it is provided that said wedge includes longitudinal guide pins slidingly engaged in corresponding slides of the base.

These pins or these slides are respectively provided with lateral teeth cooperating with opposite indentations to define preselected longitudinal positions of the wedge.

According to another embodiment of the adjustment device according to the invention that is more particularly intended for ski fastening systems in particular comprising a front stop provided with a base and a body, said support element is pivotable and includes at least one ramp cooperating by contact with a push-piece forming a lever actuated by said wedge that can move in longitudinal translation under the action of a maneuvering member.

Another aim of the invention is a ski fastening system comprising a fastening element for a boot forming a stop, characterized in that it comprises an adjustment device of the type defined above.

Still another aim of the invention is a ski fastening system comprising an element for fastening a boot forming a stop provided with a base and a body, said system being equipped with an adjusting device of the aforementioned type, characterized in that said plate forming a cover is secured to the body.

Preferably, said maneuvering member then has a hollow, accessible on the upper part of the body of the fastening element forming a stop.

The device according to the invention offers skiers the possibility of practicing either Alpine ski or cross-country ski by modifying the adjustment of the holder of the front stop to adapt it to the type of boots corresponding to the selected ski method.

The invention therefore allows the skier to eliminate a complete change of equipment, without fastening safety being compromised or deteriorated in any way.

The device according to the invention makes it possible for any person to obtain a manual, precise and easy adjustment of the holder, and in particular the skier himself, based on the type of boot (Alpine, cross-country, etc.) he wishes to use.

The adjusting operation consists of modifying the height of the upper face of the holder so as to reduce the vertical play between the curb of the boot and the jaw during putting on.

This adjustment operation is done easily and quickly using a simple screwdriver or a coin, if necessary, and it is possible to see the obtained results instantaneously.

Owing to the device according to the invention, the boot benefits from better bearing on the holder and, in particular, the quality of the bearing and the transmission of the forces is similar in all adjustment positions. In fact, unlike the devices of the prior art that only allow a vertical elevation of the holder, the device according to the invention modifies its height by pivoting, which offers an optimized angular orientation as well as wider and reinforced bearing for any type of boot sole profile.

Furthermore, the adjusting device according to the invention has a simple structure, made up of a small number of parts, and is therefore capable of being manufactured industrially under good economic conditions.

The invention will be better understood upon reading the following description, accompanied by the drawings explained below.

The device according to the invention shown in the figures is designed to complete the fastening systems equipping skis and, in particular, the fastening element forming the front stop of the boot in such systems.

Figure 1:
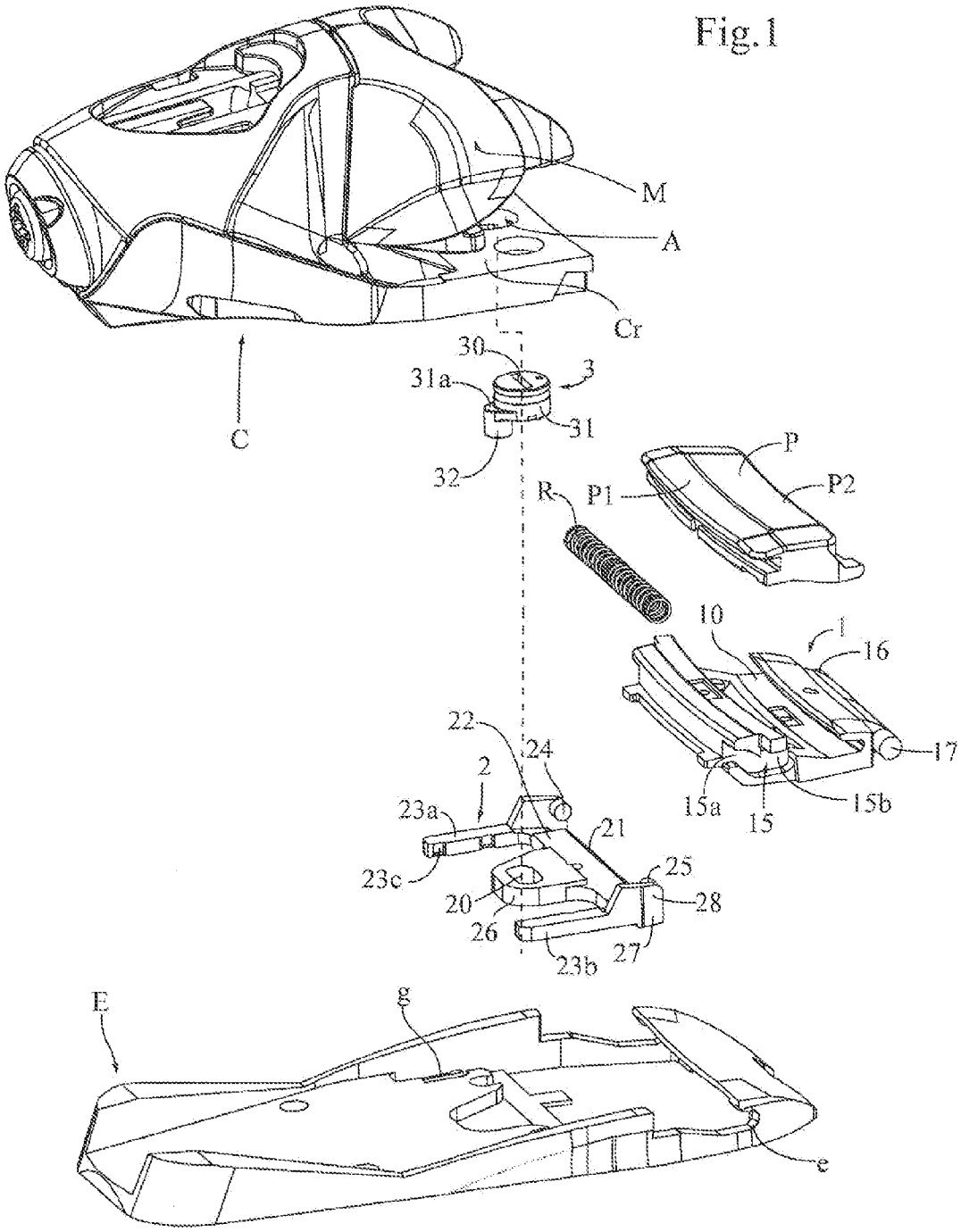
FIG. 1 shows an exploded perspective view of the front stop of a fastening system equipped with the adjusting device for the holder according to the invention.
Figure 2A:
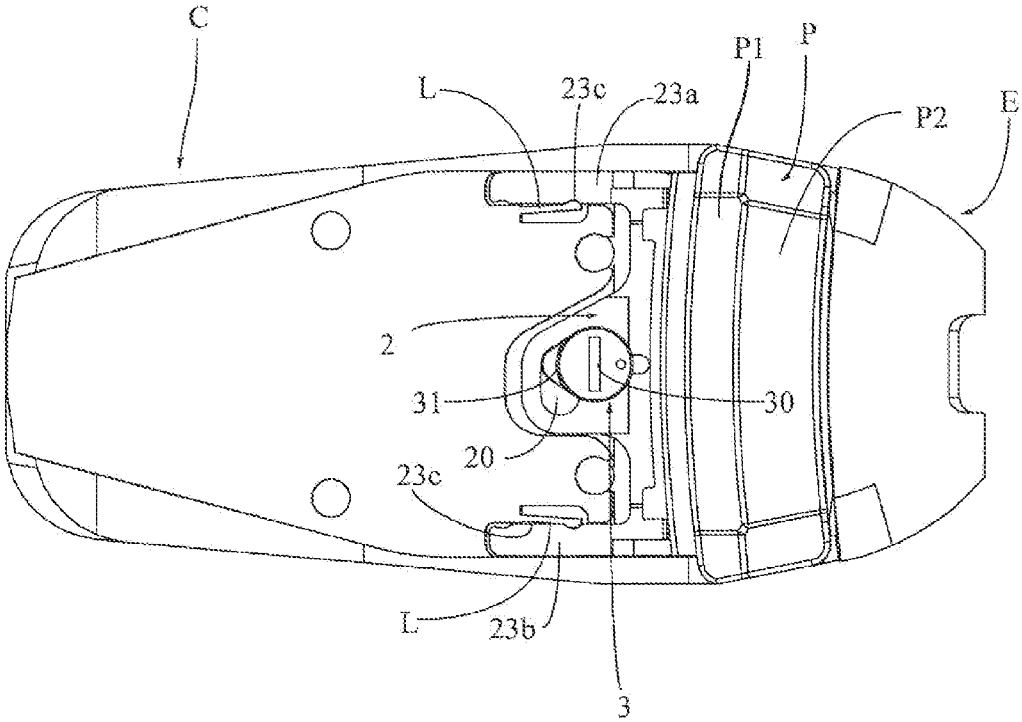
FIG. 2A shows a top view of the device mounted on the base.
Figure 2B:
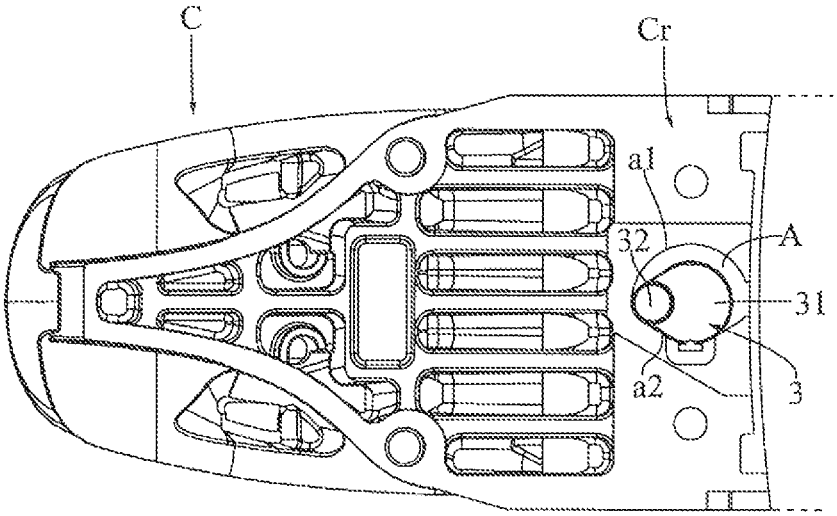
FIG. 2B is a bottom view of the fastening stop of FIG. 1 equipped with the device according to the invention shown in a partial form.

The front stop of a fastening system comprises, in particular and as shown in FIGS. 1, 2A and 2B, a base E for mounting on the ski (not shown) and a body C containing a spring making it possible to adjust the torsional activation of the front stop. Two moving jaws M are mounted on the body C and are designed to engage with the curb of a boot not shown).

These parts (base E and body C) can be made in a single piece or independently.

Thus, in the alternative illustrated in the figures, the body C has an extension in the form of a plate Cr that extends backward above the base E.

The plate Cr may be made either secured to the body or in the form of an independent part mechanically connected to the base E and forming a cover.

The device according to the invention is designed to adjust the vertical position of the bearing holder P of the boot in the illustrated fastening system.

To that end, the device includes a support element 1 of the holder P that is pivotable in the vertical direction.

More specifically, the support element 1 includes at least one ramp cooperating by contact with a push-piece forming a lever actuated by a wedge 2 that can move in longitudinal translation under the action of a maneuvering member 3 to cause the support element 1 to pivot.

Figure 3:
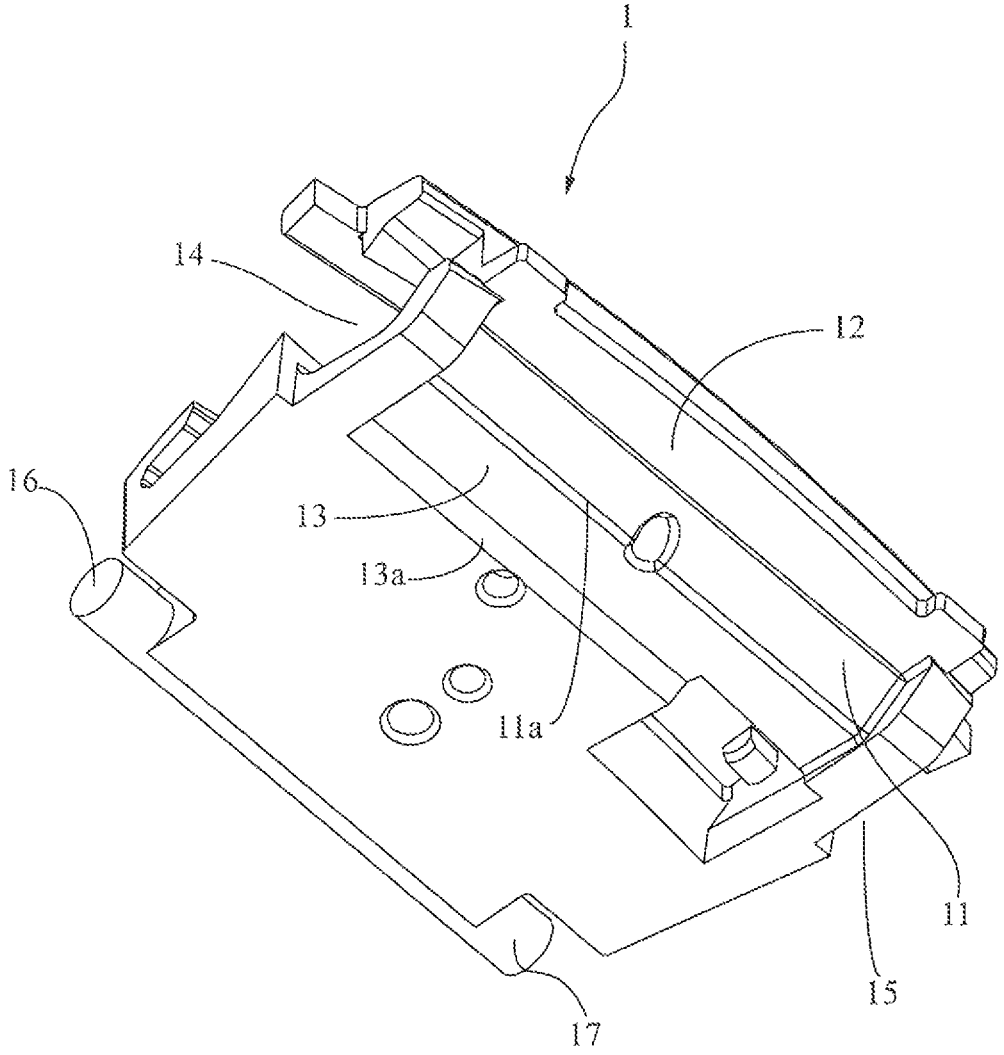
FIG. 3 shows a bottom perspective view the support element of the holder according to the invention.
Figure 4:
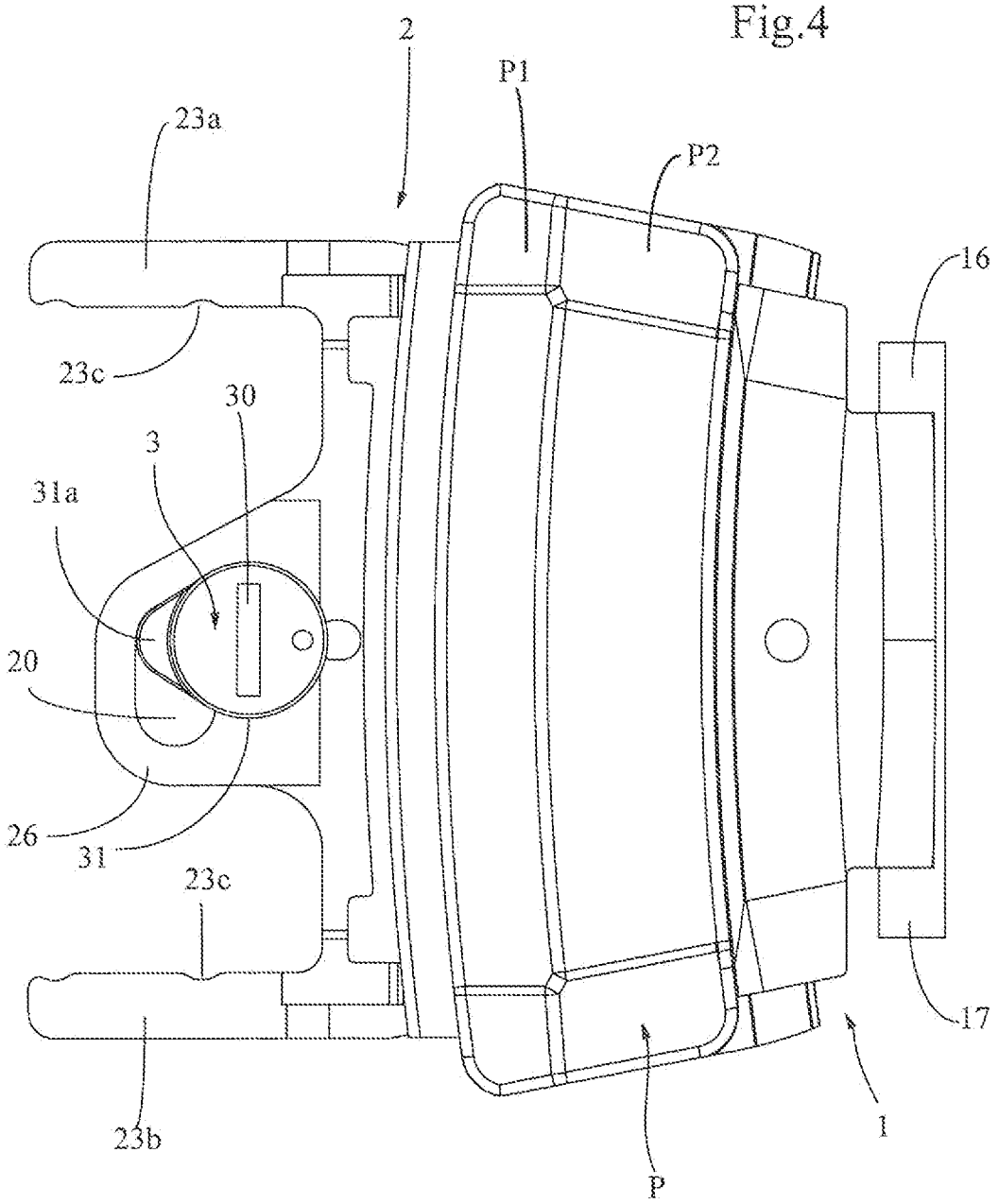
FIG. 4 shows a detailed top view of one embodiment of the device according to the invention.
Figure 6A:
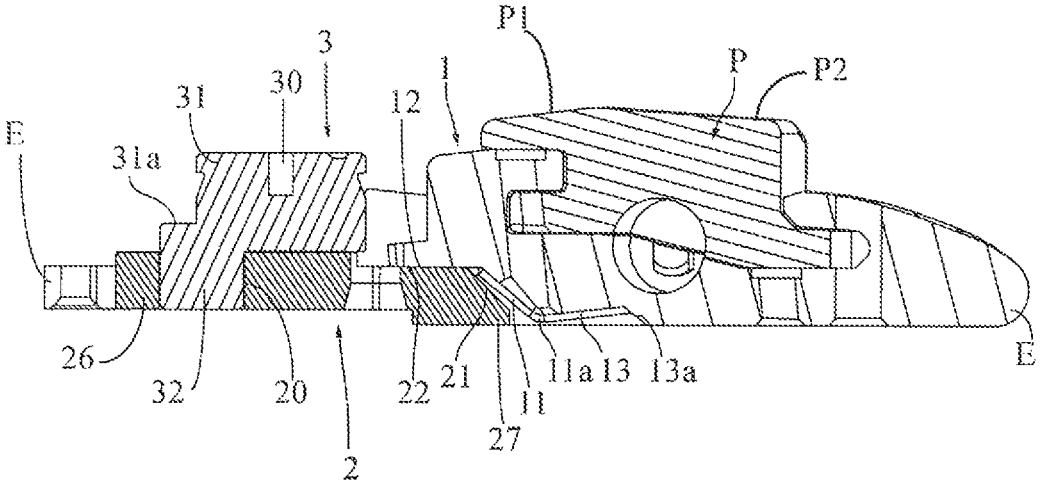
FIGS. 6A and 6B show partial and longitudinal cross-sectional views of the device according to the invention in two different adjustment positions.
Figure 6B:
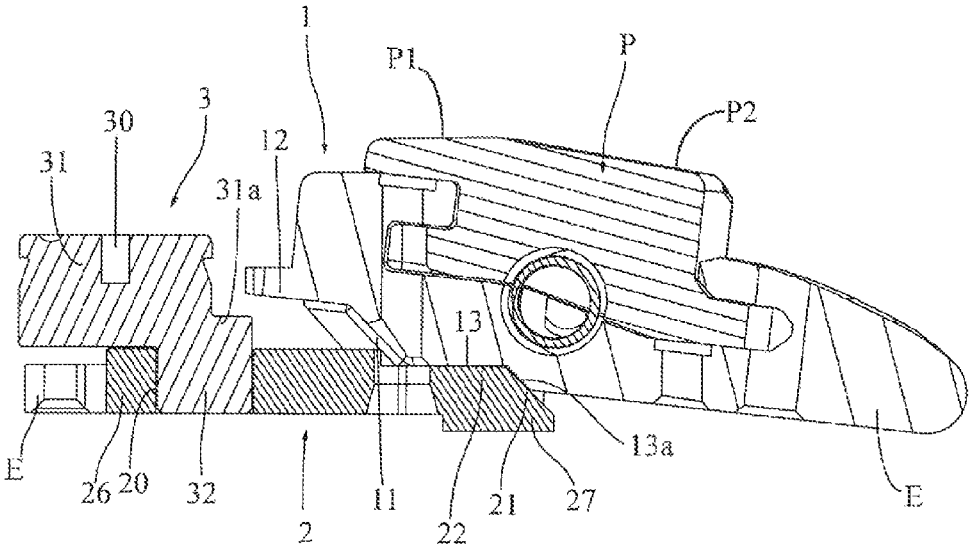

In the embodiment shown in the figures, one of the longitudinal ends (here, the front end) of the support element 1 bears the ramp, here formed by an inclined lower face 11 (visible in FIGS. 3, 6A and 6B).

However, it would be possible to provide that the ramp(s) is (are) situated more toward the rear under the support element while being offset from the pivot axis of the support element 1.

The face 11 that is inclined downward and backward cooperates by sliding contact with the push-piece 21 (FIGS. 6A, 6B) supported by the opposite end of the moving wedge 2.

Figure 5A:
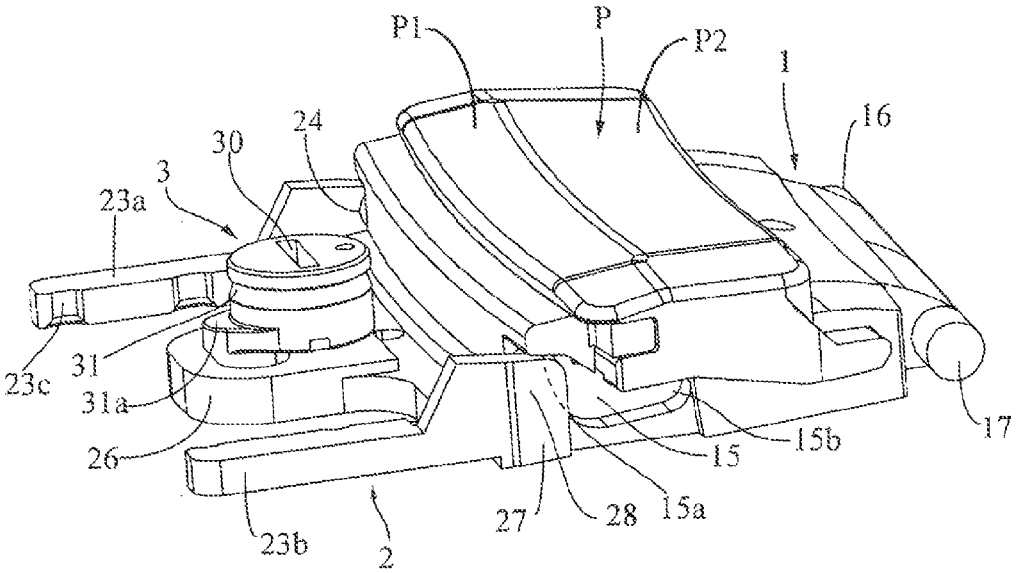
FIGS. 5A and 5B show partial perspective views of the device according to the invention in two different adjustment positions.
Figure 5B:
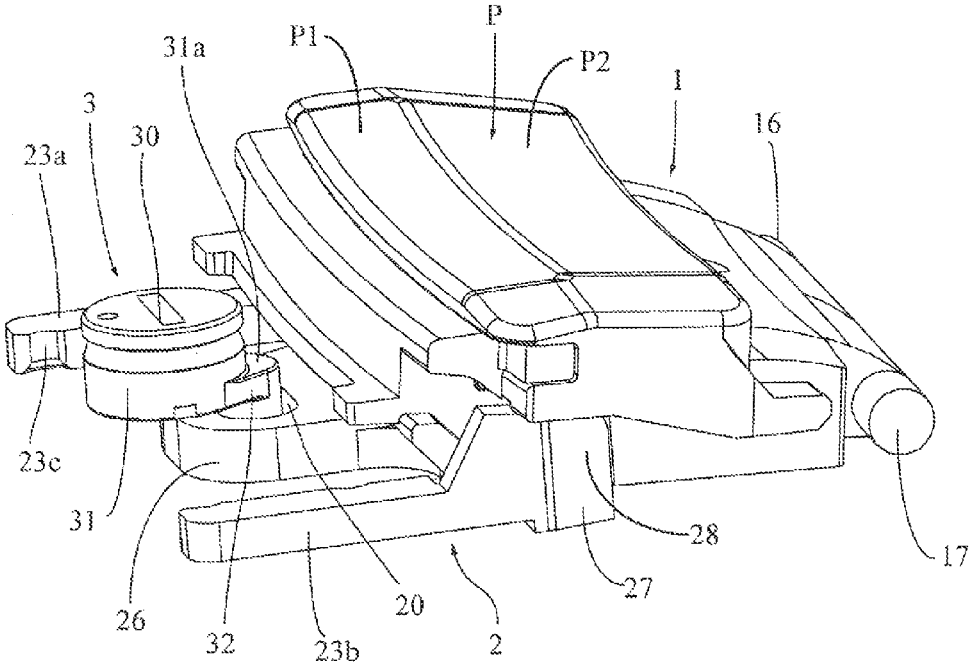

The wedge 2 here is housed in a recess of the bottom of the base E and is mounted at least partially below said support element 1 as illustrated by FIGS. 5A and 5B.

The wedge 2 can move in longitudinal translation under the action of a maneuvering member 3 (which will be described in detail hereinafter).

The movement of the wedge 2 toward the element 11 that is fixed in translation leads the push-piece 21 to exert bearing contact against the ramp 11 corresponding to a force having a vertical component F, and by sliding makes it possible to pivot the support element, and therefore the holder P, in the vertical direction.

Figure 7A:
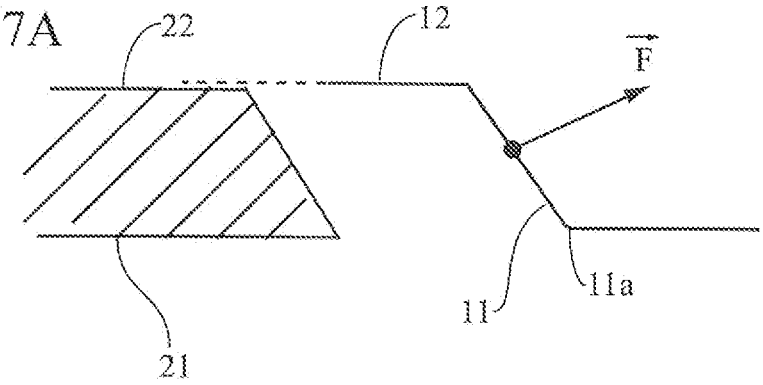
FIGS. 7A, 7B and 7C show diagrammatic cross-sectional views of three alternatives of the profile of the push-piece.
Figure 7B:
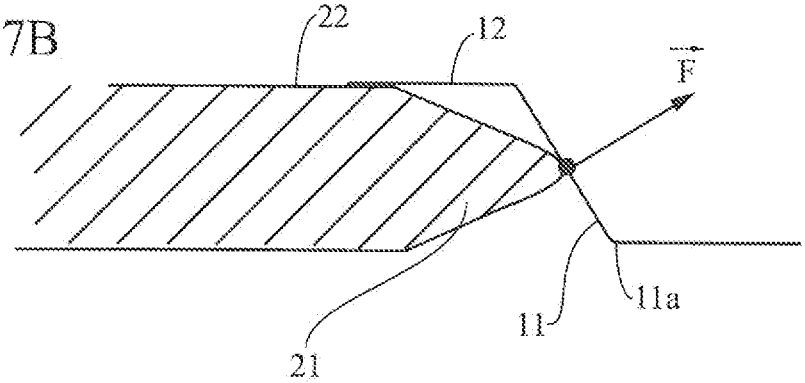
Figure 7C:
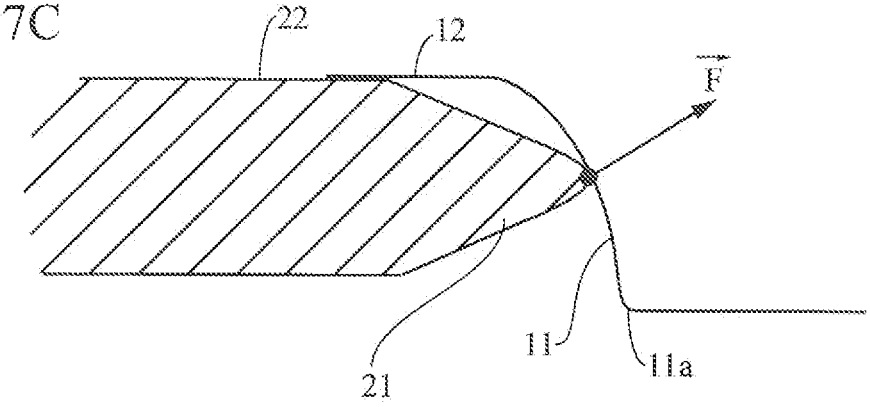

FIGS. 7A, 78 and 7C show different profiles of the push-piece 21 and the ramp 11 making it possible to obtain the expected pivoting.

This pivoting makes it possible to bring the support element 1 from a lower position (FIG. 5A) to an upper position (FIG. 5B) where the holder P is raised and vice versa.

Each of these two positions is stabilized owing to means that will be described below.

The support element 1 pivots around a transverse axis, here embodied by two pivots 16, 17 positioned on either side of the support element and which are engaged in bearings formed by lateral niches e of the base (FIG. 1).

Alternatively, the support element may pivot around a transverse axis secured to the base E.

Advantageously, the pivot axis is positioned behind the adjusting device and, more particularly, behind the support element 1.

The niches are open so that the support element can be replaced if needed, in case of wear of the holder P if it is made with the element 1 in a single piece.

Although the profile of the push-piece here is complementary to that of the ramp 11, in other alternatives of the invention it would be possible to provide that the push-piece for example has a protruding end (FIGS. 7B, 7C) still producing a forced bearing against the ramp, which results in a vertical lifting force F for the support element 1.

In the embodiment shown in the figures, the holder P is translatable along a substantially transverse axis and is housed in a cavity 10 of the support element 1 toward which it is elastically recalled by a spring R (see FIG. 1).

This type of holder is designed to accompany the movement of the boot during torsional activation of the front stop.

According to one alternative, this holder could be made up of a Teflon part fastened on the support element 1 and designed to decrease, in a known manner, the friction between the sole of the boot and the front stop during torsional activation.

The adjusting device of the holder is housed behind the plate Cr, and the support element 1 has a frontal upper part with a profile complementary to the rear part of the plate Cr, both to protect the adjusting mechanism from the outside environment (snow, dust, gravel, etc.) and ensure aesthetic integration of the adjusting device into the fastening system.

The wedge 2 includes two lateral lugs 24, 25 sliding in guide and retaining cells 14, 15 formed on each of the flanks of the support element 1 of the holder P (see FIGS. 1 and 5A).

The lugs 24, 25 are supported by lateral posts 28 secured to the wedge 2. The wedge 2 includes longitudinal guide pins 23*a*, 23*b* slidingly engaged in the corresponding slides g of the base E.

The slides g are provided with flexible longitudinal blades L bearing teeth or bosses or notches cooperating with opposite indentations 23*c* formed on the pins to define the preselected longitudinal positions of the wedge 2 in the base E.

These positions thus correspond to precise angular positions of the pivoting support element 1, and therefore to predetermined heights of the holder P.

The cells 14, 15 ensure, via cooperation with the lugs 24, 25, the axial and vertical maintenance of the wedge 2/element 1 connection, both during pivoting of the support element 1 and in the lower and upper positions.

These cells have an open upper portion 15*a* for the insertion of the lugs 24, 25 which extends downward, via a bent portion, by a closed lower portion 15*b* in which the lugs abut.

The path delimited for the lugs by the cells is copied from the kinematics of the push-piece 21 on the ramp 11.

When the holder P is movably and potentially removably mounted in the cavity 10 of the support element 1, as is the case in the embodiment shown here, the cells are then covered in the upper part by the lateral edges of the base of the holder P (see FIG. 5A).

The wedge/support element assembly is completely housed in the base E, which thus forms a lower housing.

The maneuvering member 3 is designed to manually ensure the translational movement of the wedge 2 to move the holder P from a vertical position to another position.

To that end, the member 3 comprises a cylindrical stud 31 rotatably housed in an asymmetrical bore A of the plate Cr secured to the body in its rear part (FIGS. 1 and 2B).

The stud 31 is provided with a cam here made up of an eccentric 31*a* bearing a slug 32 protruding downward.

The slug 32 connects the cam to the wedge 2 while being engaged through an oblong aperture 20 formed transversely in a tab 26 of the wedge 2 that extends on the side opposite the push-piece 21.

Of course, other forms of maneuvering members and cam elements could be used in the context of the invention.

For example, an elastic button transversely connected to the lateral sides of the wedge could fit into openings formed in the lateral walls of the base to lock the assembly in each of the adjusting positions.

The asymmetrical bore A (FIG. 28) is delimited on the one hand by a semi-cylindrical edge a1 coming into contact with the eccentric 31*a* during the rotation of the member 3, and on the other hand by a substantially triangular edge a2 whereof the distance to the center of the bore A is smaller than the radius of the edge a1 and whereof the ends form end-of-travel stops for rotational locking means for the rotating stud 31.

The apex of the triangular edge a2 is rounded.

The head of the stud 31 is preferably provided with a hollow 30 for inserting adjusting tool. The head of the stud could optionally be provided with a handle that can be actuated manually.

The push-piece 21 of the wedge 2 includes a substantially horizontal upper wall 22 on which two bearing shoulders 12, 13 of the support element 1 of the holder alternatively rest in the two lower and upper positions, respectively.

Preferably, the transitional rim between the wail 22 and the inclined face of the push-piece 21 is slightly rounded, as is the connecting zone between the shoulder 12 and the ramp 11 to avoid any locking of the push-piece.

As shown in cross-section in FIGS. 6A and 68, in front of its ramp 11, the support element 1 comprises a first bearing shoulder 12 on the wedge 2 at the opposite horizontal surface 22, ensuring stability of the holder in the lower position.

The shoulder 12 has a slope rising slightly toward the front (in the upper position of the holder, as illustrated by FIG. 6B) so as to ensure optimal stability in the lower position due to the pivoting of the support element 1 and the concomitant return of the surface of the shoulder 12 to the horizontal, as illustrated by FIG. 6A.

Behind the ramp 11, the support element 1 includes a second bearing shoulder 13 on the horizontal surface 22 of the wedge 2 delimiting a stable upper position of the holder at the end of travel of the push-piece.

The connection between the ramp 11 and the second shoulder 13 is provided by a bent zone 11*a* facilitating the passage of the push-piece 11 during its translation between its forward position (FIG. 6A) and its withdrawn position (FIG. 6B), and vice versa.

The second bearing shoulder 13 has a slope rising slightly toward the rear (in the lower position of the holder as illustrated by FIG. 6A) so as to ensure optimal stability in the upper position due to the pivoting of the support element 1 and the concomitant return of the surface of the shoulder 13 to the horizontal, as illustrated by FIG. 6B.

This second shoulder is limited, toward the rear, by an inclined face 13*a* forming a translational stop for the push-piece 21.

In the illustrated embodiment, there are two vertical positions of the holder P, but it would be possible, according to alternatives of the device, to provide a multitude of intermediate adjustment positions without going beyond the scope of the invention.

Of course, for each of these stable positions, it would be appropriate to provide a ramp framed by stable bearing means of the type of the shoulders 12, 13 described above.

The wedge 2 is preferably provided with two lateral feet 27, here extending the lateral posts 28 downward, said posts supporting the lugs 24, 25 and sliding on the upper face of the ski through the holder E.

The adjustment of the holder will now be described in detail.

In the configuration shown in FIGS. 2A, 4, 5A and 6A, the wedge 2 is in its forward position and the holder P is therefore in the lower position.

This position is stabilized by the bearing of the first shoulder 12 of the support element 1 against the horizontal wall 22 of the wedge 2.

In this configuration, the eccentric 31*a* of the stud 31 is also positioned in front and is locked in rotation in one direction by the edge a2 of the bore A (here the clockwise rotation of the pivot is prohibited, as shown in FIG. 2B in bottom view).

A user then wishing to bring the holder into the upper position must rotate the maneuvering member 3, for example by inserting the blade of the screwdriver into the hollow 30 of the head of the pivot 31.

In the illustrated embodiment, a rotation of the pivot 31 of 180° in the direction allowed by the edge a1 of the bore A (here the counterclockwise direction) makes it possible to move the eccentric 31*a* forming a cam to the left (in top view) in the aperture 20 (see FIG. 2A), which results in forcing backward translation of the wedge 2 and its push-piece 21.

More specifically, the backward movement of the push-piece 21 against the lower ramp 11 results, via a lever mechanism, in lifting the front part of the support element 1 from its lower position while the rear part pivots around the transverse axis passing through the pivots 16, 17.

This movement continues until the push-piece 21 escapes the connecting elbow 11*a* between the ramp 11 and the second shoulder 13 and abuts against the stop face 13*a*.

At that time, the holder P stabilizes itself in the upper position (FIGS. 5B, 6B).

This position is stabilized by the bearing of the second shoulder 13 of the support element 1 against the horizontal wall 22 of the wedge 2.

In practice, a travel of 10 to 15 mm of the wedge 2 makes it possible to obtain an elevation of the holder of 3 to 5 mm, which is sufficient to adapt the front stop to an alpine ski boot.

Under these conditions, the support element 1 pivots by approximately 6° relative to the horizontal.

The holder is returned to the lower position by rotating the maneuvering member 3 by 180° in the opposite direction (here, the clockwise direction).

The adjustment according to the invention makes it possible to obtain two stable positions, lower and upper, respectively, and in particular, the contact areas between the wedge and the support element are identical.

If applicable, according to one alternative that is not shown, it would be possible to provide the presence of elastic return means facilitating the return of the holder to the lower position.

Furthermore, in an alternative where the holder has two upper facets P1, P2 inclined relative to one another (as illustrated here by the figures), each being dedicated to a specific type of boot (Alpine or cross-country, for example), the pivoting of the holder then makes it possible to orient the facet that is more specifically adapted to the boot to be used in a horizontal plane.

More specifically, an Alpine boot having a substantially horizontal front lower surface will bear on the upper facet P1 the boot then being in the upper position as illustrated by FIG. 6B, while a boot adapted to cross-country skiing having a sole unwinding in its front part will bear on the upper facet P2, the holder then being in the lower position as illustrated in FIG. 6A.

Better bearing and more effective strength of the boot on the ski are thereby ensured.

The invention claimed is:

1. A device for adjusting the vertical position of a boot support holder for a ski fastening system on which the sole of a boot bears comprising a base and a plate forming a cover, said support holder comprising a vertically movable support element and at least one ramp cooperating by contact with a wedge that moves in longitudinal translation under the action of a maneuvering member, wherein said maneuvering member is mounted in rotation relative to the base while being connected to said wedge via a cam comprising a push-piece exerting bearing contact against said ramp to modify the vertical position of the support element by pivoting.

2. The device according to claim 1, wherein said maneuvering member comprises a cylindrical stud rotatably housed in an asymmetrical bore of the plate.

3. The device according to claim 1, wherein said cam is made up of an eccentric bearing a slug protruding downward through an oblong aperture formed in said wedge.

4. The device according to claim 2, wherein said asymmetrical bore is delimited on the one hand by a semi-cylindrical edge coming into contact with the eccentric during the rotation of the member, and on the other hand by a substantially triangular edge whereof the distance to the center of the bore is smaller than the radius of the edge and whereof the ends form end-of-travel stops for the rotating stud.

5. The device according to claim 2, wherein the head of said stud is provided with a hollow for the insertion of an adjusting tool.

6. The device according to claim 2, wherein said oblong aperture is formed in a tab of the wedge extending on the side opposite the push-piece.

7. The device according to 1, wherein the support element pivots around a transverse axis.

8. The device according to claim 7, wherein the pivot axis is embodied by two pivots positioned on either side of the support element and that are engaged in bearings formed by side niches of the base.

9. The device according to claim 1, wherein in front of the ramp, the support element comprises a first bearing shoulder on the wedge corresponding to a low position of the holder, and behind the ramp, it comprises a second bearing shoulder on the wedge delimiting an upper position of the holder at the end of travel of the push-piece.

10. The device according to claim 9, wherein, following the pivoting of the support element, said first or second bearing shoulder extends in a horizontal plane corresponding to the lower position or the upper position of the holder, respectively.

11. The device according to claim 9, wherein said push-piece of the wedge includes an upper wall on which said bearing shoulders of the support element of the holder rest.

12. The device according to claim 1, wherein said wedge includes two lateral lugs sliding in guide and retaining cells formed on each of the flanks of the support element of the holder.

13. The device according to claim 1, wherein said wedge is housed in a recess of the bottom of the base.

14. The device according to claim 13, wherein said wedge includes longitudinal guide pins slidingly engaged in corresponding slides of the base.

15. A device for adjusting the vertical position of the boot support holder in a ski fastening system, in particular comprising a front stop provided with a base and a body, said device comprising a support element of the holder on which the sole of the boot bears and a wedge, wherein said support element is pivotable and includes at least one ramp cooperating by contact with a push-piece designed on said wedge, said wedge being movable in longitudinal translation under the action of a maneuvering member.

16. A ski fastening system comprising a fastening element for a boot forming a stop, wherein the fastening system comprises an adjustment device according to claim 1.

17. A ski fastening system comprising an element for fastening a boot forming a stop provided with a base and a body, said system being equipped with a device for adjusting the vertical position of the boot support holder according to claim 1, wherein said plate forming a cover is secured to the body.

18. The ski fastening system according to claim 17, wherein said maneuvering member then has a hollow, accessible on the upper part of the body of the fastening element forming a stop.

* * * * *